US005866065A

United States Patent [19]

Herbelin et al.

[11] Patent Number: 5,866,065

[45] Date of Patent: Feb. 2, 1999

[54] FERRITIC STAINLESS STEEL OF USE IN PARTICULAR FOR CATALYST SUPPORTS

[75] Inventors: Jean-Marc Herbelin, Albertville; Marc Mantel, La Bathis; Jean-Yves Cogne, Ugine, all of France

[73] Assignee: Usinor Sacilor, Puteaux, France

[21] Appl. No.: 623,782

[22] Filed: Mar. 29, 1996

[30] Foreign Application Priority Data

Mar. 29, 1995 [FR] France ..... 95 03641

[51] Int. Cl.[6] ..... C22C 38/06; C22C 38/50; C22C 38/48

[52] U.S. Cl. ..... 420/40; 420/62

[58] Field of Search ..... 420/40, 60

[56] References Cited

U.S. PATENT DOCUMENTS

| | | | |
|---|---|---|---|
| 3,852,063 | 12/1974 | Niimi et al. . | |
| 4,414,023 | 11/1983 | Aggen et al. | 420/40 |
| 4,859,649 | 8/1989 | Böhnke et al. | 420/40 |
| 5,045,404 | 9/1991 | Ohmura et al. | 420/62 |
| 5,228,932 | 7/1993 | Shimizu et al. | 420/62 |

FOREIGN PATENT DOCUMENTS

| | | |
|---|---|---|
| 0 091 526 A3 | 10/1983 | European Pat. Off. . |
| 0 387 670 | 9/1990 | European Pat. Off. . |
| 0 480 461 A1 | 4/1992 | European Pat. Off. . |
| 3221087 | 12/1983 | Germany . |
| 37 06 415 | 9/1988 | Germany . |

*Primary Examiner*—Deborah Yee
*Attorney, Agent, or Firm*—Oblon, Spivak, McClelland, Maier & Neustadt, P.C.

[57] ABSTRACT

Ferritic stainless steel which resists oxidation at high temperature, of use in particular for a catalyst support structure, such as for example structures contained in the exhaust pipes of motor vehicles. This stainless steel comprises by weight:

12 to 25% chromium, 4 to 7% aluminium, less than 0.03% carbon, less than 0.02% nitrogen, less than 0.22% nickel, less than 0.002% sulphur,less than 0.6% silicon, less than 0.4% manganese, the active elements selected from the group comprising cerium, lanthanum, neodymium, praseodymium, yttrium taken alone or in combination, at a content of lower than 0.08%, at least one stabilizing element selected from the group comprising zirconium and niobium, the zirconium and/or niobium contents satisfying the following conditions:

for the zirconium, $$(C\%/12+N\%/14)-0.1 \leq Zr \leq 91\ (C\%/12+N\%/14)+0.1$$

for the niobium, $$93\times0.8(C\%/12)-0.1 \leq Nb \leq 93\times0.8(C\%/12)+0.15 \text{ and } Nb<0.3\%,$$

for the zirconium and the niobium, $$91(N\%/14)-0.05 \leq Zr \leq 91(N\%/14)+0.05 \text{ and } 93\times0.8(C\%/12)-0.05 \leq Nb \leq 93\times0.8(C\%/12)+0.10.$$

16 Claims, 3 Drawing Sheets

FERRITIC STAINLESS STEEL OF USE IN PARTICULAR FOR CATALYST SUPPORTS

The present invention relates to a ferritic stainless steel which resists oxidation at high temperature and is of use in particular for support structures of a catalyst, such as for example structures contained in the exhaust pipes of motor vehicles.

Catalyst support structures made from sheets of iron-chromium-aluminium steel are adapted to resists oxidation and deformation at high temperature.

The steels employed must be capable of being produced within the framework of industrial production, for example with continuous casting followed by transformations so as to obtain steel strips of great width and small thickness for the production of sheet or foils.

There is known from the German patents C 633 657 an iron, chromium, aluminium alloy FeCrAl having up to 30% chromium, 0.1 to 11.5% aluminium, 0.05 to 2% rare earths such as for example cerium which may contain zirconium and titanium.

There are also known from the European patent EP 0429 793 alloys FeCrAl containing rare earths, active elements such as cerium lanthanum, praseodymium and stabilizers, titanium or niobium. The addition of active elements as high contents is proposed. A minimum phosphorus content is recommended to improve the hot fragility of the alloys with respect to high contents of active elements. The minimum phosphorus contents thus proposed are lower than those usually encountered in the production of stainless steels. The addition of a stabilizer such at titanium is provided to improve the hot fragility of the alloys. The oxidation tests carried out were carried out at the temperature of 1170° C.

The U.S. Pat. No. 4,414,023 also describes alloys FeCrAl containing the active elements cerium, lanthanum, praseodymium, and stabilizers such as zirconium and/or niobium. The active elements are added to avoid the scaling of the oxide layer.

The addition of zirconium as a stabilizer under the condition $Zr \leqq 91$ (% C/12+% N/14+0,03) is provided to track the carbon and the nitrogen in form of carbides and nitrides. The addition of niobium under the condition $Nb \leqq 93$ (% C/12+% N/14+0,0075) is provided to improve the resistance to flow.

This patent mentions very high stabilizer contents and claims the stabilization of Zr as being preferable for the resistance to oxidation. It also indicates that the addition of several stabilizers is not advisable since it results in a behavior similar to that of alloys with a single stabilizer having the worst resistance to oxidation.

Further, the range of the zirconium contents is wide and does not permit satisfying all the conditions of dimensional stability of the catalyst supports. Likewise, the niobium contents do not permit obtaining an optimum resistance to oxidation.

There is also known from the patent application EP 0 480 461 relating to a ferritic steel containing aluminium and having a good resistance to oxidation in which application it is mentioned that the presence of niobium improves the creep resistance of the supports. This resistance is defined as a function of the nitrogen contents which is not justified owing to the presence of aluminium and/or zirconium, since compounds of aluminium nitride and zirconium nitride are formed in a preferential manner to the niobium nitride.

An object of the invention is to provide a ferritic stainless steel, of use in particular for catalyst support structures subjected to a temperature variation cycle and having an improved resistance as concerns oxidation and elongation deformation at high temperature.

The invention provides a stainless steel comprising in its composition by weight:

12 to 25% chromium 4 to 7% aluminium less than 0.03% carbon less than 0.02% nitrogen less than 0.22% nickel less than 0.002% sulphur less than 0.6% silicon less than 0.4% manganese, active elements selected from the group comprising cerium, lanthanum, neodymium, praseodymium, yttrium taken alone or in combination, at a content of lower than 0.08%, at least one stabilizing element selected from the group comprising zirconium and niobium, the zirconium and/or niobium contents satisfying the following conditions:

for the zirconium, $$91(C\ \%/12+N\ \%/14)0.1 \leqq Zr \leqq 91(C\ \%/12+N\ \%/14)+0.1$$

for the niobium, $$93\times0.8(C\ \%/12)-0.1<Nb<93\times0.8(C\ \%/12)+0.15 \text{ and } Nb<0.3\%,$$

for the zirconium and the niobium, $$91(N\ \%/14)-0.05 \leqq Zr \leqq 91(N\ \%/14)+0.05, \text{ and } 93\times0.8(C\ \%/12)-0.05 \leqq Nb \leqq 93\times0.8(C\ \%/12)+0.10.$$

Other features of the invention are:

The active elements are selected from the group comprising cerium, lanthanum, neodymium, praseodymium, taken alone or in combination and contained in the compound named "mischmetal".

The sum of the zirconium and niobium contents is lower than 0.300%.

The sum of the carbon and nitrogen contents is lower than 0.04%.

The silicon and manganese contents satisfy the relation $Si/Mn \geqq 1$.

For the stabilizing element zirconium used alone in the composition, the minimum aluminium content satisfies the following condition:

$$4\%+6Zr\ \%-91(C\ \%/12+N\ \%/14).$$

For the stabilizing element niobium used alone in the composition, the minimum aluminium content satisfies the following condition:

$$4\%+5Nb\ \%-93(C\ \%/12+N\ \%/14).$$

For the combined stabilizing elements zirconium and niobium, the minimum aluminium content satisfies the following condition:

$$4\%+5(Zr+Nb)-92\ (C\ \%/12+N\ \%/14).$$

When the zirconium is introduced alone in the composition, the content of active elements satisfies the following relation:

$$0.03-0.2(Zr\%-91\ N\%/14) \leqq (Ce+La+Nd+Pr+Y) \leqq 0.08-0.2(Zr\%-91N\%/14).$$

When the niobium is introduced alone in the composition, the content of active elements satisfies the following relation:

$$0.03-0.025(Nb\%)\leqq(Ce+La+Nd+Pr+Y)\leqq0.08-0.025(Nb\%).$$

When the zirconium and niobium are introduced in the composition in combination, the content of active elements satisfies the following relation:

$$0.03-0.2(Zr\%-91N\%/14)-0.025(Nb\%)\leqq(Ce+La+Nd+Pr+Y)\leqq0.08-0.2(Zr\%-91N\%/14)-0.025(Nb\%).$$

The following description and the accompanying drawings given merely by way of a non limitative example will explain the invention.

FIG. 1 group s the characteristics of resilience by the measurement of the transition temperature for steels having different selected stabilizing contents.

The ferritic stainless steel according to the invention which resists oxidation at high temperature has the following composition by weight:

Cr:(12–25) % ; Al:(4–7) %; C≦0.03%; N≦0.02%; S≦0.002% Si≦0.6%; Mn≦0.4% active elements selected from the group comprising cerium, lanthanum, praseodymium, neodymium, yttrium, taken alone or in combination at a content ≦0.08%, stabilizers selecte d from the group comprising zirconium, niobium, taken alone or in combination, at a content ≦0.003%.

Preferably, the active elements are selected from the group compr ising cerium, lanthanum, praseodymium, neodymium, taken alone or in combination, these elements being the constituents of the mixture named "mischmetal".

The lanthanum may be replaced by yttrium which has closely similar chemical properties.

The steel intended in particular for manufacturing catalyst support structures employing a sheet whose thickness is generally less than 200 μm, must have a resistance to oxidation at temperatures usually lower than 1150° C. during several hundreds of hours. The support structure must have a hot and cold transformation capability and must also satisfy the characteristics of elongation deformation during the oxidation.

According to the invention, precise conditions have been found concerning the contents of stabilizing elements and active elements which must be met for producing steel in the form of rolled strips and for improving the resistance to oxidation and elongation of said steel.

From the point of view of the production and the transformation in the hot state, the beneficial effect of the addition of stabilizers which permits reducing the ductile/fragile transition temperatures has been found. However, an excess of stabilizing elements is harmful. According to the invention, it has been shown that it is essential to control the contents of stabilizers to meet the following conditions:

For a steel according to the invention stabilized with zirconium:

$$91(C\%/12+N\%/14)-0.1\leqq Zr\leqq91(C\%/12+N\%/14)+0.1$$

For a steel according to the invention stabilized with niobium:

$$93\times0.8(C\%/12)-0.1\leqq Nb\leqq93\times0.8(C\%/12)+0.15 \text{ and } Nb<0.3\%$$

For a steel according to the invention stabilized with zirconium and niobium:

$$91(N\%/14)-0.5\leqq Zr\leqq91(N\%/14)+0.05 \text{ and } 93\times0.8(C\%/12)-0.05\leqq Nb\leqq93\times0.8(C\%/12)+0.10.$$

The coefficient 0.8 is a factor imposed by the analysis of the stoichiometry of the compounds based on niobium precipitated in the matrix.

Figure 1:
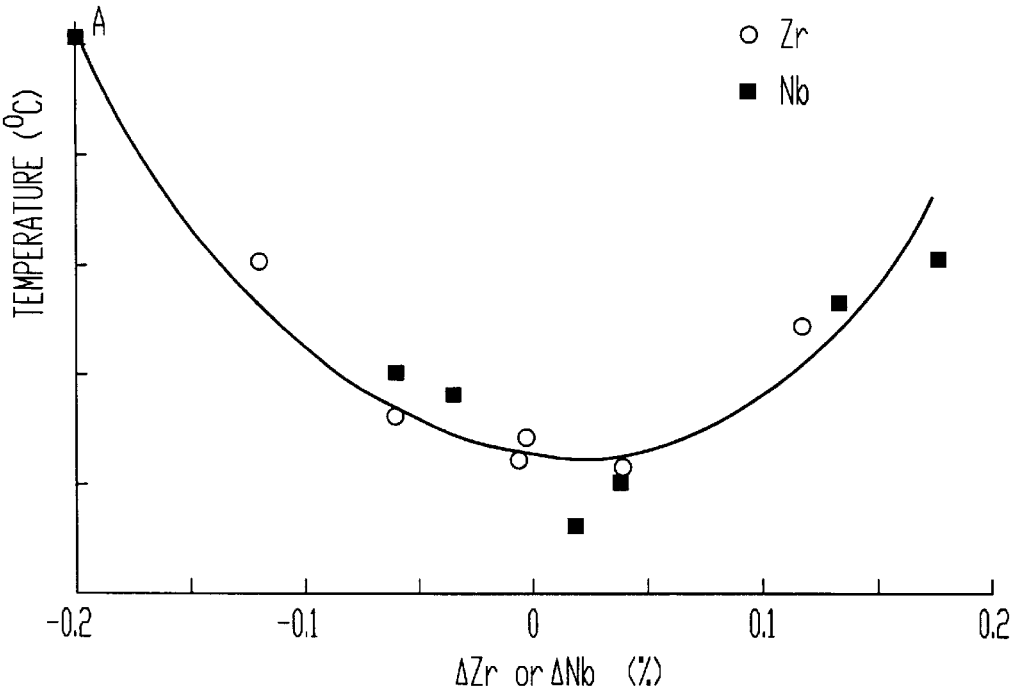

FIG. 1 groups the characteristics of resilience measured by means of transition temperatures of steels having different contents of stabilizers selected from the group comprising zirconium and niobium.

Shown as abscissae are:

the content of free zirconium AZr so that AZr satisfies the following relation:

$$\delta Zr\ \%=Zr\ \%-91\ (C\ \%/12+N\ \%/14),$$

the content of free niobium δNb so that δNb satisfies the following relation:

$$\delta Zr\ \%=Nb\ \%-93\times0.8(C\ \%/12)$$

It is found that an excess, just as much as a lack,of stabilizing element in the composition of the steel is harmful.

It is therefore necessary to control the contents of zirconium and/or niobium so as to impart to the steel ductile/fragile transition temperatures which are as low as possible. The control of the stabilizing elements is important in view of the continuous casting production process. An uncontrolled stabilization may result in a fragilization of the slabs which is incompatible with an industrial production.

From the point of view of the choice of the stabilizers, steels containing zirconium, or niobium or titanium in their composition were tested for oxidation at different temperatures selected between 900° C. and 1400° C.

The oxidation test comprises measuring a gain of mass δM with respect to a unit surface area S.

The gain in mass, corresponding to an oxidation, obeys a law of the type $(\delta M/S)^2=Kp^t$, in which Kp is a constant of a parabolic law of the exponential type which is a function of the temperature and the activation energy of the oxidation reaction, and t is the duration of the test.

Figure 2:
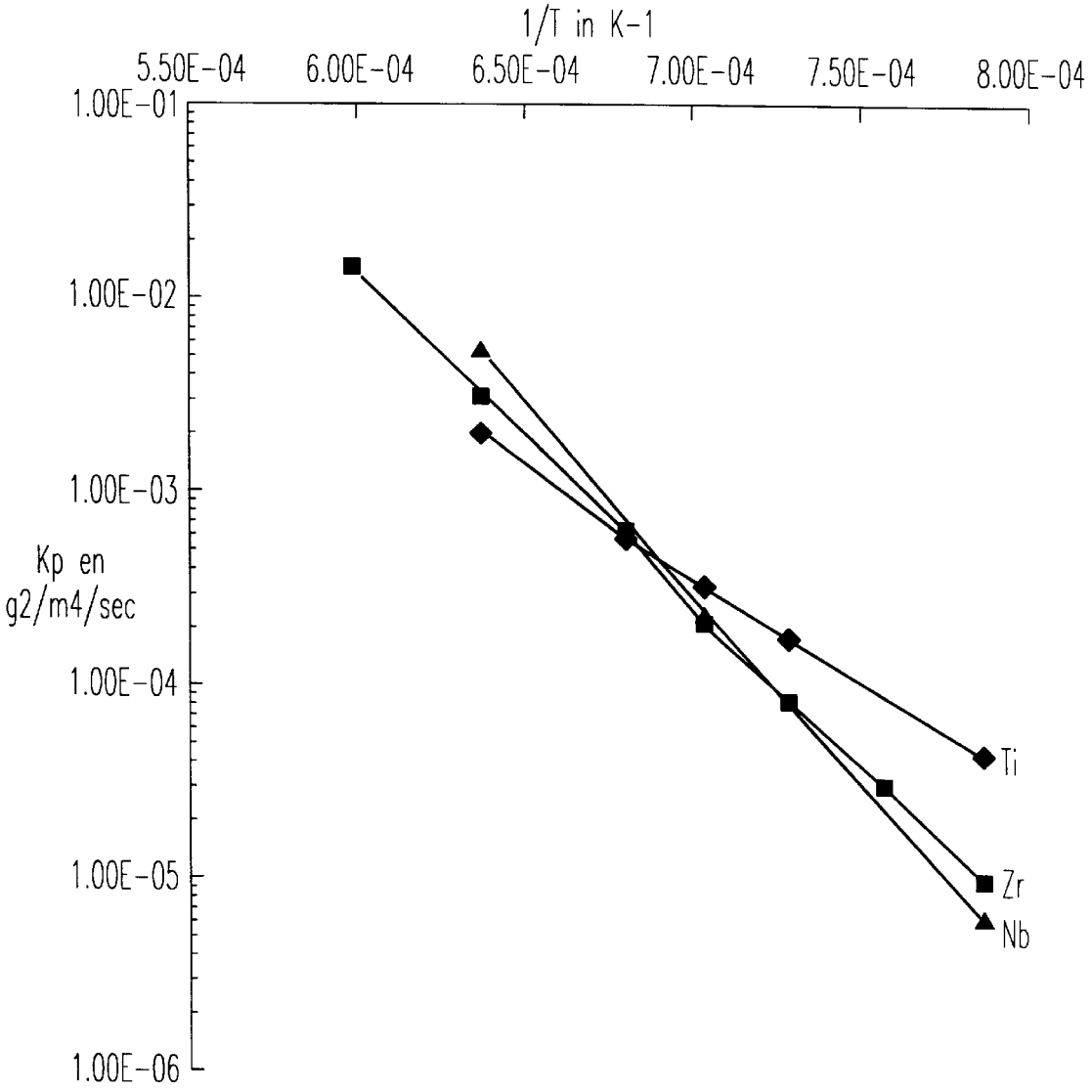
FIG. 2 shows a series of characteristics of evolution of the constants of the oxidation kinetics as a function of the temperature for different stabilizers.

Plotted in FIG. 2 are:

variations of Kp ($g^2/m^4/sec$) as a function of the inverse of the absolute temperature 1/T for steel stabilized with titanium, zirconium, or niobium. The oxidation reaction rates are expressed by the values of the parabolic constant Kp. When these values are low, the kinetics are slower and the oxidation smaller. The good oxidation resistance is obtained for the values of Kp which are as low as possible. According to this Figure, it can be seen that, irrespective of the type of steel, the parabolic constants increase with the temperature. The oxidation kinetics therefore also logically increase with the temperature.

This Figure also shows that the nature of the stabilizers modifies these kinetics and that, surprisingly, they may have a beneficial or harmful effect, depending on the temperature of utilization. Thus, at temperatures higher than 1150° C., it is the titanium which has the best protective character as concerns oxidation. At temperatures lower than 1150° C., on the other hand, the addition of titanium has a harmful effect as compared with the addition of niobium or zirconium. The extreme temperature of utilization of metal catalyst support structures is usually below 1150° C. It can be seen from this Figure, and bearing in mind the temperatures of utilization of catalyst support structures, that the best stabilizers are niobium and/or zirconium. The addition of titanium does not give good results within the envisaged temperature range. Further, the combined addition of zirconium and niobium does not result in a deterioration of the grade in the proportions defined by the invention, contrary to that mentioned in the prior art. In FIG. 2 ,it can be seen that the addition of stabilizers results in considerable differences in the oxidation kinetics.

The amount of aluminium required to resist oxidation for a given temperature and time therefore depends on the nature of the stabilizers. Thus, to exhibit a resistance to oxidation at 1150° C. during 400 hours, we have established the minimum amounts of aluminium required as a function of the stabilizers and the carbon and nitrogen content.

For the zirconium:

$$\text{Al \% minimum}=4\%+6\ \text{Zr \%}-91\ (\text{C \%}/12+\text{N \%}/14).$$

For the niobium:

$$\text{Al \% minimum}=4\%+5\ \text{Nb \%}-93\times0.8(\text{C \%}/12).$$

It will be noticed that the amount of aluminium required for the stabilization with titanium satisfies the following relation:

$$\text{Al \% minimum}=4\%+20\ \text{Ti \%}-48\ (\text{C \%}/12+\text{N \%}/14).$$

For the combined addition of zirconium and niobium we have:

$$\text{Al \% minimum}=4\%+6\ \text{Zr \%}+5\ \text{Nb \%}-91(\text{N\%}/14)93\times0.8\ (\text{C \%}/12).$$

The addition of titanium results in high minimum values of aluminium which are incompatible with an industrial production.

The formation of the layer of oxide in the course of the oxidation treatment creates stresses. These stresses are not negligible and may deform the catalyst support structure. The catalyst support structure undergoes variations in elongation as a function of time at a given temperature. These variations are manifested by a high elongation during a relatively short period of time and then by a stability of the elongation during a period of time corresponding to a step or plateau and, lastly, by high elongations during a relatively long period of time. The high elongations occurring during a long period are related to the formation of chromium oxide diffused in the layer of alumina. This type of elongation has been identified and is related to a diminution in the aluminium content of the composition of the sheet.

Figure 3:
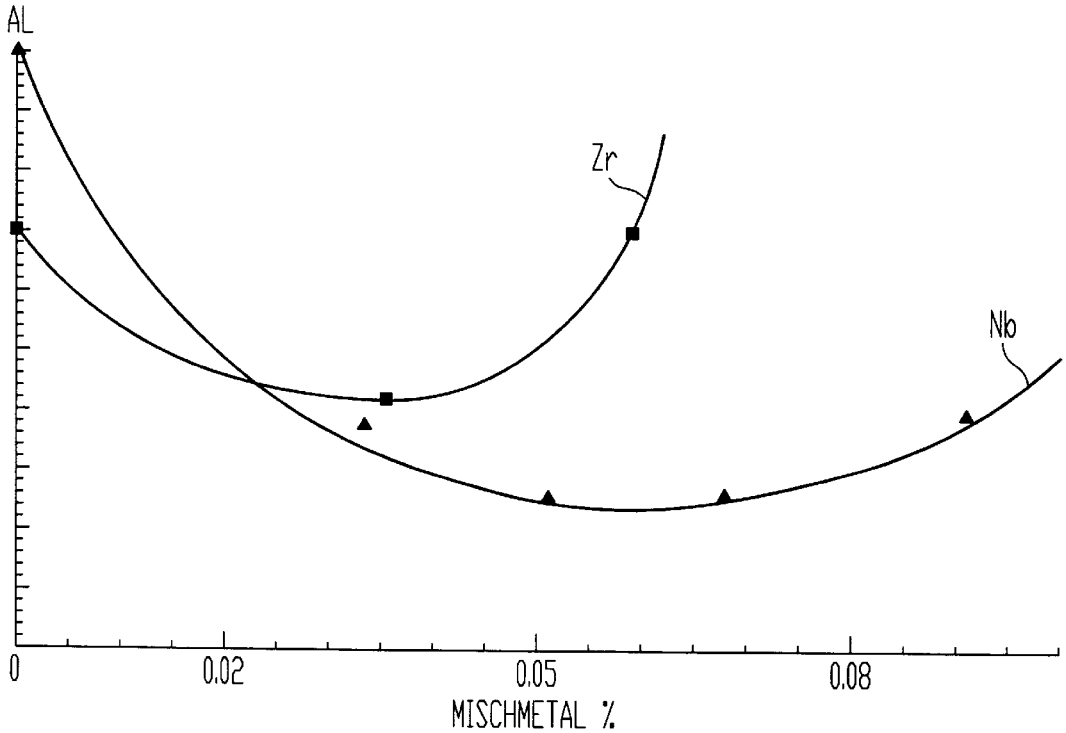
FIG. 3 shows a series of curves of elongation as a function of the content of active elements.

FIG. 3 shows the elongations at the step as a function of the content of active elements. The elongation at the step depends in this example on the content of the active elements Ce, La, Pr, Nd included in the composition of the "mischmetal" but also, surprisingly, on the stabilizing element employed. For example, the content of "mischmetal" depends on the content of zirconium since the latter is an active element from the oxidation point of view. Thus, the best resistances as concerns elongation deformation are obtained for "mischmetal" contents of between 0.02 and 0.04% for a zirconium stabilization and between 0.04 and 0.075% for steel stabilized with niobium. The addition of these elements which trap the sulphur, improves the resistance to oxidation of the steels. These additions must be so controlled as to optimize the properties of the steel. The simultaneous addition of Zr and Nb provides a possibility of increasing the range of the content of active elements which is between 0.02 and 0.075%.

Figure 4:
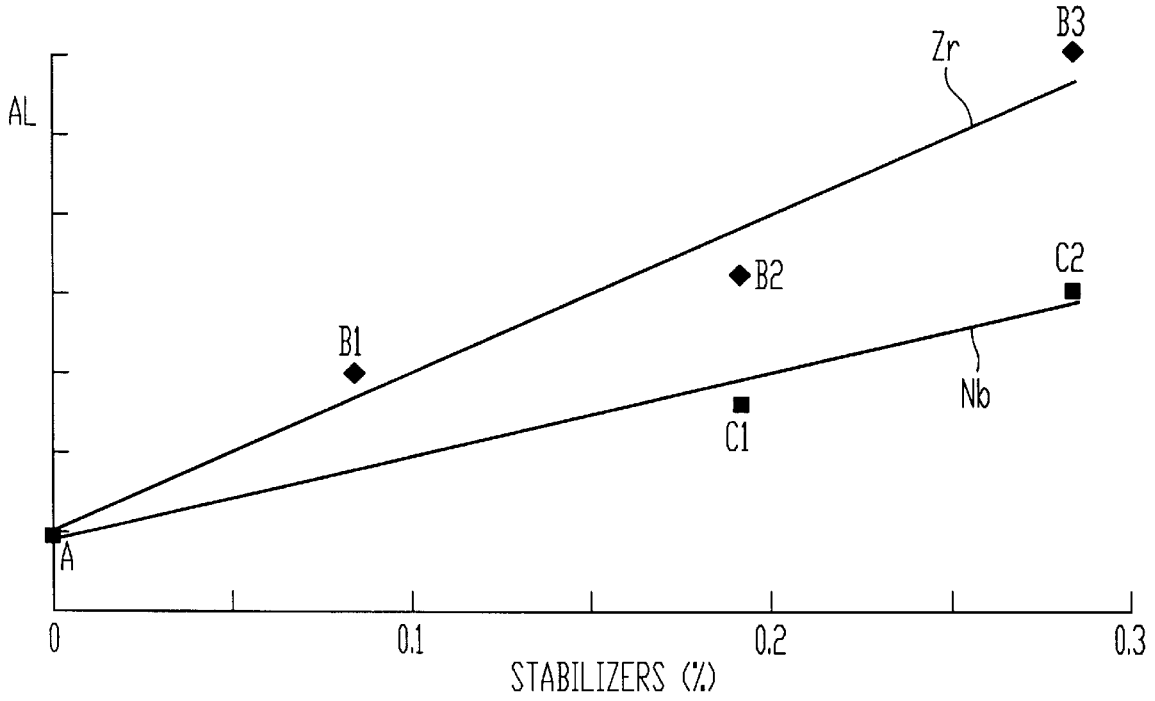
FIG. 4 shows a series of characteristics in elongation for different zirconium and niobium contents in compositions having a defined content of active elements.

FIG. 4 shows a diagram giving the behavior as concerns elongation deformation at the step for different zirconium and niobium contents, the zirconium and niobium contents being adjusted in accordance with the carbon and nitrogen contents.

As concerns the step values of elongation, the best results are obtained with the addition of niobium. The addition of zirconium gives higher values. The origin of this phenomenon is related to the reactivity of the stabilizers for oxygen. The reactivity of these stabilizers is greatly limited when they are added in a controlled amount in relation to the proportions of carbon a nitrogen.

The following table 1 gives the different compositions of the alloys A, B1, B2, B3, C1, C23 shown in the Figure.

| | A | B1 | B2 | B3 | C1 | C2 |
|---|---|---|---|---|---|---|
| C | 0.019 | 0.009 | 0.018 | 0.037 | 0.014 | 0.017 |
| Si | 0.296 | 0.319 | 0.386 | 0.560 | 0.350 | 0.340 |
| Mn | 0.285 | 0.299 | 0.428 | 0.295 | 0.288 | 0.290 |
| Ni | 0.195 | 0.215 | 0.150 | 0.196 | 0.216 | 0.214 |
| Cr | 20.10 | 20.19 | 20.18 | 22.10 | 20.03 | 20.11 |
| Mo | 0.033 | 0.033 | 0.041 | 0.018 | 0.031 | 0.028 |
| Cu | 0.036 | 0.039 | 0.035 | 0.012 | 0.035 | 0.043 |
| S | <5 ppm | 2 ppm | 9 ppm | 4 ppm | <10 ppm | <10 ppm |
| P | 0.020 | 0.020 | 0.020 | 0.011 | 0.018 | 0.021 |
| Al | 5.03 | 4.7 | 5.18 | 4.6 | 5.2 | 5.4 |
| N | 0.007 | 0.004 | 0.008 | 0.012 | 0.006 | 0.006 |
| Ce | 0.0351 | 0.0133 | 0.0177 | 0.0111 | 0.0339 | 0.023 |
| La | 0.0151 | 0.0064 | 0.0082 | 0.0050 | 0.0155 | 0.010 |
| Zr | — | 0.083 | 0.191 | 0.284 | 0.006 | — |
| Nb | — | — | — | — | 0.205 | 0.285 |

This Figure shows that the step elongation increases linearly with the content of stabilizer. In order to obtain the best resistance to elongation, the contents of stabilizers and consequently the contents of carbon and nitrogen, must be limited to very low values:

$$(\text{C+N})\leqq0.04\%\ \text{Zr and/or Nb}\leqq0.300\%.$$

The simultaneous addition of Zr and Nb traps the carbon and the nitrogen and forms essentially compounds of the type ZrN and NbC. This choice considerably reduces the amount of free stabilizers available for the oxidation owing to the thermodynamic stability of the nitrides ZrN. The formation of NbC develops during the thermal cycle owing to the lower chemical affinity of niobium for oxygen.

Carbon and nitrogen are elements which inevitably form part of the composition of steels. These elements result in a very high reduction in ductility in the hot state and present problems in the transformation of the steel.

The presence of zirconium and/or niobium stabilizers, which trap the carbon or the nitrogen, improves the ductility of the alloy in the hot state. However, high carbon and nitrogen contents on the other hand result in stabilizing contents which are also very high. The considerable precipitation of carbides and nitrides in the alloy reduce the resistance to oxidation of the product by rendering the oxide layer fragile.

Thus, in order to limit the presence of an excessive number of precipitates, the carbon content must be lower than 0.03%, the nitrogen content must be lower than 0.02% and the carbon and nitrogen content must be preferably lower than 0.04%.

According to the invention, it is preferable to limit the nitrogen contents to less than 0.01% so as to reduce the zirconium contents and improve the elongation characteristics of the steel.

The zirconium and/or the niobium are voluntary addition elements provided for trapping the carbon and/or the nitrogen and thereby improving the hot ductility of the grade. These stabilizing elements must be controlled in view of the envisaged continuous casting production process. Indeed, an insufficient stabilization would render the slabs excessively fragile which is incompatible with an industrial production. A high stabilization would result in a deterioration of the resistance to oxidation of the steel in the sheet form.

The combined addition of the stabilizing elements zirconium and niobium provide both a good oxidation resistance and a good cohe sion of the supports. Indeed, apart from the properties of niobium as a stabilizer, it permits an adhesion between the sheets rolled in a spiral of the supports.Thus, the niobium may allow the elimination of the brazing tracks, for example based on nickel, and a possible contamination due to the brazing filler metal.

However, the niobium may modify the oxidation kinetics and must not be added in a proportion exceeding 0.3%.

The product must resist for several hundreds of hours at very high temperature i.e.up to 1100° C. To satisfy this condition, the alloy must contain at least 4% aluminium. This content is required for forming a protective oxide layer on the surface and avoiding the premature diminution of the aluminium content in the sheet. The aluminium content must be lower than 7% in order to avoid problems in the transformation of the grade resulting from an excessive deterioration of the ductility in the hot state.

For alloys containing these aluminium contents, aluminium nitride are preferentially formed rather than niobium nitrides.

Silicon and manganese are very oxidizable elements and also play a non negligible part in the resistance to elongation. These two elements, under the effect of a treatment at high temperature, have a tendency to migrate to the surface of the metal. There are then two possibilities:

these elements remain on the surface and are possibly oxidized if the chemical activity of the elements is sufficient, this is more particularly the case with silicon. In the case of steels containing a lot of aluminium, oxidation of the silicon is impossible. This element remains on the surface and effectively participates in the protection by performing the function of a barrier to the diffusion of other elements.

these elements migrate toward the surface and are sublimated. This is more particularly the case with manganese which is found in large amounts on the walls of furnaces for treatments under a vacuum. This phenomenon is harmful from the point of view of elongation deformation since the evaporation of the manganese liberates the surface of the metal and causes the oxidation of elements which have a high chemical affinity for oxygen.

For these two reasons, it is important for retaining good oxidation resisting properties to maintain the ratio $Si/Mn \geqq 1$.

Concerning the other elements contained in the composition of the steel according to the invention:

The phosphorus and the sulphur are inevitable impurities involved in the manufacture of stainless steels.

The phosphorus is usually found in stainless steels at a content of about 0.02%. This element plays a neutral or slightly beneficial part in the resistance of the product to oxidation by trapping the excess cerium in the form of phosphides. The sulphur is also found in stainless steels at a content of about 0.005%. The sulphur has a harmful effect on the resistance to oxidation. It reduces the adherence of the oxide to the sheet and promotes the scaling or flaking of this layer. For this reason, the sulphur must be kept at the lowest possible content: lower than 0.002%.

The chromium content of the steel must be sufficient, that is, higher than 12% ,for presenting good properties as concerns corrosion and promoting the formation and the resistance of the layer of oxide at high temperature. The chromium content must not be too high either, namely lower than 25% in order to avoid steel transformation problems.

According to the invention, preferably the chromium content is between 14 and 22%, which corresponds to an optimized chromium concentration range as concerns corrosion and the transformation of the steel.

Copper introduced in the composition is a residual element found in the basic products employed in the production of steel.

The product resulting from the invention is intended for the manufacture of metal support structures of catalysts from sheets whose thickness is less than 200 $\mu$m and more commonly equal to 50 $\mu$m±10 $\mu$m.

What is claimed is:

1. Ferritic stainless steel resisting oxidation at high temperature, of use in particular for a catalyst support, consisting of the composition thereof, in addition to iron, by weight:

12–25% chromium
4–7% aluminum
less than 0.03% carbon
less than 0.02% nitrogen
0.15–0.22% nickel
0.0002–0.002% sulfur
less than 0.6% silicon
less than 0.4% manganese,
less than 0.5% copper, active elements selected from the group consisting of cerium, lanthanum, neodymium, praseodymium, yttrium, taken alone and combinations thereof, at a content of less than 0.08%, a least one stabilizing element selected from the group consisting of zirconium and niobium, said zirconium content and said niobium content satisfying the following conditions:

for said zirconium, $$91(C\%/12+N\%/14)-0.1 \leqq Zr \leqq 91\ (C\%/12+N\%/14)+0.1$$

for said niobium, $$93\times0.8(C\%/12)-0.1 \leqq Nb \leqq 93\times0.8(C\%/12)+0.15 \text{ and } Nb<0.3\%,$$

for a combination of said zirconium and said niobium, $$91(N\%/14)-0.05 \leqq Zr \leqq 91\ (N\%/14)+0.05, \text{ and } 93\times0.8\ (C\%/12)-0.05 \leqq Nb \leqq 93\times0.8\ (C\%/12)+0.10.$$

2. Steel according to claim 1, wherein said active elements are selected from the group comprising cerium, lanthanum, neodymium, praseodymium, taken alone and combinations thereof, and contained in a compound named "mischmetal".

3. Steel according to claim 1, wherein the sum of the zirconium and niobium contents is less than 0.300%.

4. Steel according to claim 1, wherein the sum of the carbon and nitrogen contents is less than 0.04%.

5. Steel according to claim 1, wherein, said silicon content and said manganese content satisfy the relation $Si/Mn \geqq 1$.

6. Steel according to claim 1, wherein, for said stabilizing element zirconium used alone in said composition, the minimum aluminium content satisfies the following condition:

$$4\%+6\ Zr\ \%-91\ (C\ \%/12+N\ \%/14).$$

7. Steel according to claim 1, wherein, for said stabilizing element niobium used alone in said composition, the minimum aluminium content satisfies the following condition:

$$4\%+5\ Nb\ \%-93\ (C\ \%/12+N\ \%/14).$$

8. Steel according to claim 1, wherein, for said combination of said stabilizing elements zirconium and niobium, the minimum aluminium content satisfies the following condition:

$$4\%+5\ (Zr+Nb)-92\ (C\ \%/12+N\ \%/14).$$

9. Steel according to claim 1, wherein the content of active elements satisfies the following relation:

$$0.03-0.2(Zr\%-91\ N\%/14)\leqq(Ce+La+Nd+Pr+Y)\leqq 0.08-0.2(Zr\%-91\ N\%/14).$$

10. Steel according to claim 1, wherein the content of active elements satisfies the following relation:

$$0.03-0.025(Nb\%)\leqq(Ce+La+Nd+Pr+Y)\leqq 0.08-0.025(Nb\%).$$

11. Steel according to claim 1, wherein the content of active elements satisfies the following relation:

$$0.03-0.2(Zr\%-91N\%/14)-0.025(Nb\%)\leqq(Ce+La+Nd+Pr+Y)\leqq 0.08-0.2(Zr\%-91;N\%/14)-0.025(Nb\%).$$

12. Steel according to claim 3, wherein the sum of the carbon and nitrogen contents is less than 0.04%.

13. Steel according to claim 1, comprising zirconium and niobium.

14. Steel according to claim 12, comprising zirconium and niobium.

15. Steel according to claim 1, comprising zirconium.

16. Steel according to claim 1, comprising niobium.

* * * * *